US008096064B2

(12) United States Patent
Matsunaga et al.

(10) Patent No.: US 8,096,064 B2
(45) Date of Patent: Jan. 17, 2012

(54) METHOD FOR DRYING LUMBER, METHOD OF IMPREGNATING LUMBER WITH CHEMICALS, AND DRYING APPARATUS

(75) Inventors: Masahiro Matsunaga, Tsukuba (JP); Koichi Setoyama, Tsukuba (JP); Yutaka Kataoka, Tsukuba (JP); Hiroaki Matsui, Tsukuba (JP); Hiroshi Matsunaga, Tsukuba (JP); Takeshi Fujiwara, Tsukuba (JP)

(73) Assignee: Forestry and Forest Products Research Institute, Ibaraki (JP)

( * ) Notice: Subject to any disclaimer, the term of this patent is extended or adjusted under 35 U.S.C. 154(b) by 690 days.

(21) Appl. No.: 12/000,741

(22) Filed: Dec. 17, 2007

(65) Prior Publication Data

US 2008/0178490 A1 Jul. 31, 2008

(30) Foreign Application Priority Data

Jan. 26, 2007 (JP) ..... 2007-015813

(51) Int. Cl.
*F26B 7/00* (2006.01)

(52) U.S. Cl. ..... 34/396; 34/413; 34/497

(58) Field of Classification Search ..... 34/396, 34/337, 245, 413, 497, 90, 105; 427/297, 427/422; 144/380; 219/682, 690
See application file for complete search history.

(56) References Cited

U.S. PATENT DOCUMENTS 3,685,959 A * 8/1972 Dunn, Jr. et al. ..... 28/377
3,859,934 A * 1/1975 Weholt ..... 110/203
3,900,615 A * 8/1975 Dunn, Jr. ..... 427/317
3,986,268 A * 10/1976 Koppelman ..... 34/257
4,009,835 A * 3/1977 Syrjanen ..... 241/28
4,017,421 A * 4/1977 Othmer ..... 423/659
4,072,274 A * 2/1978 Syrjanen ..... 241/28
4,123,221 A * 10/1978 Danford ..... 432/152
4,283,252 A * 8/1981 Reinhall ..... 162/23
4,421,595 A * 12/1983 Huusari ..... 162/23
4,457,804 A * 7/1984 Reinhall ..... 162/254
4,493,797 A * 1/1985 Avedesian ..... 530/507
4,543,190 A * 9/1985 Modell ..... 210/721
4,671,192 A * 6/1987 Hoffert et al. ..... 110/347
4,714,591 A * 12/1987 Avedesian ..... 422/140
4,724,780 A * 2/1988 Hoffert et al. ..... 110/263
4,850,288 A * 7/1989 Hoffert et al. ..... 110/214
4,882,107 A * 11/1989 Cavender et al. ..... 264/51
4,946,965 A * 8/1990 Jahnke et al. ..... 548/368.7
4,992,308 A * 2/1991 Sunol ..... 427/297
5,009,367 A * 4/1991 Nielsen ..... 239/3
5,009,745 A * 4/1991 Hossain et al. ..... 162/5
5,009,746 A * 4/1991 Hossain et al. ..... 162/5
5,013,366 A * 5/1991 Jackson et al. ..... 134/1

(Continued)

FOREIGN PATENT DOCUMENTS

DE 3120927 A1 * 6/1982

(Continued)

*Primary Examiner* — Stephen M. Gravini
(74) *Attorney, Agent, or Firm* — Wenderoth, Lind & Ponack, L.L.P.

(57) ABSTRACT

A method for drying lumber in a short time with less use of energy. The method of drying lumber includes: enclosing lumber in a batch container having a pressure release valve; filling fluid into the batch container under pressure; maintaining a temperature and a pressure at or above a critical point of the fluid for a certain period of time; and then opening the pressure release valve of the batch container to reduce the internal pressure to atmospheric pressure.

10 Claims, 2 Drawing Sheets

U.S. PATENT DOCUMENTS

| | | | | | |
|---|---|---|---|---|---|
| 5,057,342 | A * | 10/1991 | Hoy et al. | 427/422 |
| 5,066,522 | A * | 11/1991 | Cole et al. | 427/422 |
| 5,074,958 | A * | 12/1991 | Blaney et al. | 162/5 |
| 5,106,659 | A * | 4/1992 | Hastings et al. | 427/427.4 |
| 5,108,799 | A * | 4/1992 | Hoy et al. | 427/422 |
| 5,120,558 | A * | 6/1992 | Nguyen et al. | 426/425 |
| 5,126,058 | A * | 6/1992 | Beckman | 210/774 |
| 5,141,156 | A * | 8/1992 | Hoy et al. | 239/135 |
| 5,169,687 | A * | 12/1992 | Sunol | 427/297 |
| 5,170,727 | A * | 12/1992 | Nielsen | 110/346 |
| 5,171,613 | A * | 12/1992 | Bok et al. | 427/422 |
| 5,178,325 | A * | 1/1993 | Nielsen | 239/1 |
| 5,203,843 | A * | 4/1993 | Hoy et al. | 239/135 |
| 5,211,342 | A * | 5/1993 | Hoy et al. | 239/707 |
| 5,213,660 | A * | 5/1993 | Hossain et al. | 162/5 |
| 5,232,604 | A * | 8/1993 | Swallow et al. | 210/759 |
| 5,288,619 | A * | 2/1994 | Brown et al. | 435/134 |
| 5,290,602 | A * | 3/1994 | Argyropoulos et al. | 427/422 |
| 5,340,614 | A * | 8/1994 | Perman et al. | 427/2.24 |
| 5,364,475 | A * | 11/1994 | Levien et al. | 134/42 |
| 5,374,305 | A * | 12/1994 | Glancy et al. | 106/287.23 |
| 5,419,487 | A * | 5/1995 | Nielsen et al. | 239/10 |
| 5,466,490 | A * | 11/1995 | Glancy et al. | 427/422 |
| 5,508,060 | A * | 4/1996 | Perman et al. | 427/2.14 |
| 5,509,959 | A * | 4/1996 | Nielsen et al. | 106/287.35 |
| 5,572,880 | A * | 11/1996 | Frustaci et al. | 62/259.3 |
| 5,689,968 | A * | 11/1997 | Frustaci et al. | 62/259.3 |
| 5,716,558 | A * | 2/1998 | Nielsen et al. | 264/13 |
| 5,747,042 | A * | 5/1998 | Choquet | 424/725.1 |
| 5,766,522 | A * | 6/1998 | Daly et al. | 264/13 |
| 5,803,936 | A * | 9/1998 | Huber | 48/61 |
| 5,942,008 | A * | 8/1999 | Curto | 8/402 |
| 5,975,874 | A * | 11/1999 | Daly et al. | 425/204 |
| 6,075,074 | A * | 6/2000 | Daly et al. | 523/330 |
| 6,095,212 | A * | 8/2000 | Izumi et al. | 144/380 |
| 6,106,896 | A * | 8/2000 | Nielsen et al. | 427/195 |
| 6,114,414 | A * | 9/2000 | Daly et al. | 523/330 |
| 6,124,226 | A * | 9/2000 | Nielsen et al. | 502/9 |
| 6,228,897 | B1 * | 5/2001 | Daly et al. | 521/79 |
| 6,235,403 | B1 * | 5/2001 | Vinden et al. | 428/537.1 |
| 6,267,920 | B1 * | 7/2001 | Arakawa et al. | 264/570 |
| 6,286,231 | B1 * | 9/2001 | Bergman et al. | 34/410 |
| 6,357,142 | B1 * | 3/2002 | Bergman et al. | 34/410 |
| 6,426,136 | B1 * | 7/2002 | Rouse et al. | 428/327 |
| 6,473,994 | B1 * | 11/2002 | Dedieu et al. | 34/396 |
| 6,503,396 | B2 * | 1/2003 | Kim et al. | 210/634 |
| 6,543,156 | B2 * | 4/2003 | Bergman et al. | 34/410 |
| 6,575,721 | B1 * | 6/2003 | Daly et al. | 425/6 |
| 6,583,187 | B1 * | 6/2003 | Ernst et al. | 521/56 |
| 6,663,954 | B2 * | 12/2003 | Rouse et al. | 428/327 |
| 6,675,495 | B2 * | 1/2004 | Dedieu et al. | 34/245 |
| 6,709,602 | B2 * | 3/2004 | Spritzer et al. | 210/750 |
| 6,932,155 | B2 * | 8/2005 | Vinegar et al. | 166/245 |
| 6,969,123 | B2 * | 11/2005 | Vinegar et al. | 299/3 |
| 6,991,045 | B2 * | 1/2006 | Vinegar et al. | 175/45 |
| 7,011,154 | B2 * | 3/2006 | Maher et al. | 166/245 |
| 7,051,808 | B1 * | 5/2006 | Vinegar et al. | 166/250.1 |
| 7,063,145 | B2 * | 6/2006 | Veenstra et al. | 166/250.01 |
| 7,066,257 | B2 * | 6/2006 | Wellington et al. | 166/272.2 |
| 7,073,578 | B2 * | 7/2006 | Vinegar et al. | 166/245 |
| 7,077,198 | B2 * | 7/2006 | Vinegar et al. | 166/245 |
| 7,077,199 | B2 * | 7/2006 | Vinegar et al. | 166/250.01 |
| 7,086,465 | B2 * | 8/2006 | Wellington et al. | 166/272.1 |
| 7,090,013 | B2 * | 8/2006 | Wellington | 166/267 |
| 7,100,994 | B2 * | 9/2006 | Vinegar et al. | 299/7 |
| 7,114,566 | B2 * | 10/2006 | Vinegar et al. | 166/256 |
| 7,121,341 | B2 * | 10/2006 | Vinegar et al. | 166/302 |
| 7,121,342 | B2 * | 10/2006 | Vinegar et al. | 166/302 |
| 7,128,153 | B2 * | 10/2006 | Vinegar et al. | 166/285 |
| 7,140,393 | B2 * | 11/2006 | Sheydayi | 137/875 |
| 7,156,176 | B2 * | 1/2007 | Vinegar et al. | 166/302 |
| 7,165,615 | B2 * | 1/2007 | Vinegar et al. | 166/302 |
| 7,179,849 | B2 * | 2/2007 | Terry | 523/122 |
| 7,219,734 | B2 * | 5/2007 | Bai et al. | 166/302 |
| 7,223,828 | B2 * | 5/2007 | Arjunan | 526/336 |
| 7,291,565 | B2 * | 11/2007 | Hansen et al. | 438/745 |
| 7,319,125 | B2 * | 1/2008 | Arjunan et al. | 526/127 |
| 7,326,756 | B2 * | 2/2008 | Arjunan | 526/127 |
| 7,339,018 | B2 * | 3/2008 | Arjunan | 526/336 |
| 7,360,588 | B2 * | 4/2008 | Vinegar et al. | 166/59 |
| 7,378,156 | B2 * | 5/2008 | Terry | 428/425.9 |
| 7,389,654 | B2 * | 6/2008 | Wikstrom et al. | 62/606 |
| 7,394,182 | B2 * | 7/2008 | Pelrine et al. | 310/328 |
| 7,434,590 | B2 * | 10/2008 | Sheydayi | 134/200 |
| 7,435,447 | B2 * | 10/2008 | Parent | 427/345 |
| 7,461,691 | B2 * | 12/2008 | Vinegar et al. | 166/60 |
| 7,491,036 | B2 * | 2/2009 | Parent et al. | 417/153 |
| 7,524,383 | B2 * | 4/2009 | Parent et al. | 148/243 |
| 7,547,421 | B2 * | 6/2009 | McSherry et al. | 422/424 |
| 7,547,539 | B2 * | 6/2009 | Ikegami et al. | 435/289.1 |
| 7,640,980 | B2 * | 1/2010 | Vinegar et al. | 166/268 |
| 7,790,787 | B2 * | 9/2010 | Williams et al. | 524/13 |
| 7,942,203 | B2 * | 5/2011 | Vinegar et al. | 166/252.1 |
| 2002/0000410 | A1 * | 1/2002 | Kim et al. | 210/634 |
| 2002/0026729 | A1 * | 3/2002 | Bergman et al. | 34/410 |
| 2002/0045347 | A1 * | 4/2002 | Worm et al. | 438/689 |
| 2002/0095816 | A1 * | 7/2002 | Bergman et al. | 34/415 |
| 2002/0173682 | A1 * | 11/2002 | Tullio et al. | 585/240 |
| 2002/0179541 | A1 * | 12/2002 | Spritzer et al. | 210/761 |
| 2003/0026975 | A1 * | 2/2003 | Rouse et al. | 428/327 |
| 2003/0037458 | A1 * | 2/2003 | Dedieu et al. | 34/245 |
| 2003/0173072 | A1 * | 9/2003 | Vinegar et al. | 166/66.5 |
| 2003/0173081 | A1 * | 9/2003 | Vinegar et al. | 166/272.1 |
| 2003/0173085 | A1 * | 9/2003 | Vinegar et al. | 166/302 |
| 2003/0178191 | A1 * | 9/2003 | Maher et al. | 166/65.1 |
| 2003/0183390 | A1 * | 10/2003 | Veenstra et al. | 166/302 |
| 2003/0192691 | A1 * | 10/2003 | Vinegar et al. | 166/250.12 |
| 2003/0192693 | A1 * | 10/2003 | Wellington | 166/267 |
| 2003/0196788 | A1 * | 10/2003 | Vinegar et al. | 166/57 |
| 2003/0196789 | A1 * | 10/2003 | Wellington et al. | 166/64 |
| 2003/0196801 | A1 * | 10/2003 | Vinegar et al. | 166/263 |
| 2003/0196810 | A1 * | 10/2003 | Vinegar et al. | 166/300 |
| 2003/0201098 | A1 * | 10/2003 | Karanikas et al. | 166/53 |
| 2003/0205378 | A1 * | 11/2003 | Wellington et al. | 166/302 |
| 2004/0020642 | A1 * | 2/2004 | Vinegar et al. | 166/245 |
| 2004/0040715 | A1 * | 3/2004 | Wellington et al. | 166/302 |
| 2004/0050406 | A1 * | 3/2004 | Sehgal | 134/26 |
| 2004/0094144 | A1 * | 5/2004 | Ikegami et al. | 127/1 |
| 2004/0110909 | A1 * | 6/2004 | Arjunan | 526/90 |
| 2004/0110910 | A1 * | 6/2004 | Arjunan | 526/127 |
| 2004/0110911 | A1 * | 6/2004 | Arjunan | 526/127 |
| 2004/0116551 | A1 * | 6/2004 | Terry | 523/122 |
| 2004/0122191 | A1 * | 6/2004 | Arjunan et al. | 526/127 |
| 2004/0140095 | A1 * | 7/2004 | Vinegar et al. | 166/302 |
| 2004/0140096 | A1 * | 7/2004 | Sandberg et al. | 166/302 |
| 2004/0144540 | A1 * | 7/2004 | Sandberg et al. | 166/302 |
| 2004/0144541 | A1 * | 7/2004 | Picha et al. | 166/302 |
| 2004/0145969 | A1 * | 7/2004 | Bai et al. | 367/37 |
| 2004/0146288 | A1 * | 7/2004 | Vinegar et al. | 392/301 |
| 2004/0177966 | A1 * | 9/2004 | Vinegar et al. | 166/302 |
| 2004/0211569 | A1 * | 10/2004 | Vinegar et al. | 166/380 |
| 2005/0000244 | A1 * | 1/2005 | Wikstrom et al. | 62/606 |
| 2005/0006097 | A1 * | 1/2005 | Sandberg et al. | 166/302 |
| 2005/0051327 | A1 * | 3/2005 | Vinegar et al. | 166/256 |
| 2005/0084532 | A1 * | 4/2005 | Howdle et al. | 424/486 |
| 2005/0092483 | A1 * | 5/2005 | Vinegar et al. | 166/60 |
| 2005/0260311 | A1 * | 11/2005 | Garwood | 426/480 |
| 2005/0279707 | A1 * | 12/2005 | Matthews et al. | 210/634 |
| 2005/0288204 | A1 * | 12/2005 | Matts et al. | 510/375 |
| 2006/0065288 | A1 * | 3/2006 | Babic et al. | 134/2 |
| 2006/0102208 | A1 * | 5/2006 | Jacobson et al. | 134/56 R |
| 2006/0134332 | A1 * | 6/2006 | Babic | 427/294 |
| 2006/0144515 | A1 * | 7/2006 | Tada et al. | 156/344 |
| 2006/0278254 | A1 * | 12/2006 | Jackson | 134/21 |
| 2007/0012337 | A1 * | 1/2007 | Hillman et al. | 134/1.3 |
| 2007/0131411 | A1 * | 6/2007 | Vinegar et al. | 166/59 |
| 2007/0164641 | A1 * | 7/2007 | Pelrine et al. | 310/800 |
| 2007/0178051 | A1 * | 8/2007 | Pruitt et al. | 424/46 |
| 2007/0209799 | A1 * | 9/2007 | Vinegar et al. | 166/302 |
| 2007/0218298 | A1 * | 9/2007 | Terry | 428/447 |
| 2007/0259169 | A1 * | 11/2007 | Williams et al. | 428/312.6 |
| 2007/0259766 | A1 * | 11/2007 | Jackson | 494/36 |
| 2008/0051476 | A1 * | 2/2008 | Russell et al. | 518/718 |
| 2008/0095677 | A1 * | 4/2008 | McSherry et al. | 422/189 |
| 2008/0153997 | A1 * | 6/2008 | Casty et al. | 526/88 |
| 2008/0178490 | A1 * | 7/2008 | Matsunaga et al. | 34/337 |
| 2008/0188635 | A1 * | 8/2008 | Brant et al. | 526/351 |

2008/0199536 A1* 8/2008 Terry ..... 424/618
2008/0199623 A1* 8/2008 Terry ..... 427/402
2008/0209799 A1* 9/2008 Woods et al. ..... 44/411
2008/0234443 A1* 9/2008 Kiss et al. ..... 526/64
2008/0251454 A1* 10/2008 Waibel et al. ..... 210/634
2008/0275132 A1* 11/2008 McSherry et al. ..... 514/714
2008/0281040 A1* 11/2008 Kiss et al. ..... 525/54
2009/0000184 A1* 1/2009 Garwood ..... 44/307
2009/0071647 A1* 3/2009 Vinegar et al. ..... 166/266
2009/0076214 A1* 3/2009 Kiss et al. ..... 524/570
2009/0076216 A1* 3/2009 Kiss et al. ..... 524/579
2009/0163642 A1* 6/2009 Kiss et al. ..... 524/525
2009/0163643 A1* 6/2009 Kiss et al. ..... 524/528
2009/0183693 A1* 7/2009 Furman ..... 122/16.1
2009/0205370 A1* 8/2009 Costa et al. ..... 65/17.2
2009/0208365 A1* 8/2009 Mcsherry et al. ..... 422/2
2009/0226586 A1* 9/2009 Garwood ..... 426/442
2009/0288788 A1* 11/2009 Castor ..... 162/14
2009/0293882 A1* 12/2009 Terry ..... 128/207.14
2009/0305355 A1* 12/2009 Henriksen et al. ..... 435/72
2010/0043782 A1* 2/2010 Kilambi et al. ..... 127/1
2010/0069626 A1* 3/2010 Kilambi ..... 536/56
2010/0111830 A1* 5/2010 Boyden et al. ..... 424/1.11
2010/0111831 A1* 5/2010 Boyden et al. ..... 424/1.11
2010/0111832 A1* 5/2010 Boyden et al. ..... 424/1.11
2010/0111833 A1* 5/2010 Boyden et al. ..... 424/1.11
2010/0111834 A1* 5/2010 Boyden et al. ..... 424/1.11
2010/0111835 A1* 5/2010 Boyden et al. ..... 424/1.11
2010/0111836 A1* 5/2010 Boyden et al. ..... 424/1.11
2010/0111837 A1* 5/2010 Boyden et al. ..... 424/1.11
2010/0111841 A1* 5/2010 Boyden et al. ..... 424/1.29
2010/0111842 A1* 5/2010 Boyden et al. ..... 424/1.29
2010/0111843 A1* 5/2010 Boyden et al. ..... 424/1.29
2010/0111844 A1* 5/2010 Boyden et al. ..... 424/1.29
2010/0111845 A1* 5/2010 Boyden et al. ..... 424/1.29
2010/0111846 A1* 5/2010 Boyden et al. ..... 424/1.29
2010/0111847 A1* 5/2010 Boyden et al. ..... 424/1.29
2010/0111848 A1* 5/2010 Boyden et al. ..... 424/1.29
2010/0111849 A1* 5/2010 Boyden et al. ..... 424/1.29
2010/0111850 A1* 5/2010 Boyden et al. ..... 424/1.29
2010/0111854 A1* 5/2010 Boyden et al. ..... 424/1.49
2010/0111855 A1* 5/2010 Boyden et al. ..... 424/1.49
2010/0111857 A1* 5/2010 Boyden et al. ..... 424/1.61
2010/0111938 A1* 5/2010 Boyden et al. ..... 424/133.1
2010/0112067 A1* 5/2010 Boyden et al. ..... 424/489
2010/0112068 A1* 5/2010 Boyden et al. ..... 424/489
2010/0112093 A1* 5/2010 Boyden et al. ..... 424/700
2010/0113614 A1* 5/2010 Boyden et al. ..... 514/769
2010/0113615 A1* 5/2010 Boyden et al. ..... 514/769
2010/0114013 A1* 5/2010 Boyden et al. ..... 604/35
2010/0114267 A1* 5/2010 Boyden et al. ..... 607/96
2010/0114268 A1* 5/2010 Boyden et al. ..... 607/96
2010/0114348 A1* 5/2010 Boyden et al. ..... 700/97
2010/0114496 A1* 5/2010 Boyden et al. ..... 702/19
2010/0114497 A1* 5/2010 Boyden et al. ..... 702/19
2010/0114545 A1* 5/2010 Boyden et al. ..... 703/11
2010/0114546 A1* 5/2010 Boyden et al. ..... 703/11
2010/0114547 A1* 5/2010 Boyden et al. ..... 703/11
2010/0114592 A1* 5/2010 Boyden et al. ..... 705/2
2010/0119557 A1* 5/2010 Boyden et al. ..... 424/400
2010/0121466 A1* 5/2010 Boyden et al. ..... 700/17
2010/0126727 A1* 5/2010 Vinegar et al. ..... 166/302
2010/0143243 A1* 6/2010 Boyden et al. ..... 424/1.29
2010/0152326 A1* 6/2010 Kurz ..... 523/339
2010/0152651 A1* 6/2010 Boyden et al. ..... 604/66
2010/0152880 A1* 6/2010 Boyden et al. ..... 700/117
2010/0163576 A1* 7/2010 Boyden et al. ..... 222/71
2010/0168900 A1* 7/2010 Boyden et al. ..... 700/117
2010/0181066 A1* 7/2010 Vinegar et al. ..... 166/252.1
2010/0185174 A1* 7/2010 Boyden et al. ..... 604/503
2010/0187728 A1* 7/2010 Boyden et al. ..... 264/442
2010/0191003 A1* 7/2010 Isobe et al. ..... 549/403
2010/0228067 A1* 9/2010 Peterson et al. ..... 585/500
2010/0279044 A1* 11/2010 Williams et al. ..... 428/36.5
2010/0280171 A1* 11/2010 Williams et al. ..... 524/570
2011/0092726 A1* 4/2011 Clarke ..... 554/175

FOREIGN PATENT DOCUMENTS

DE 3801518 A1 * 8/1989
DE 4202320 A1 * 8/1993
DE 19951627 A1 * 7/2000
GB 2169869 A * 7/1986
JP 57047640 A * 3/1982
JP 60067107 A * 4/1985
JP 60262888 A * 12/1985
JP 63039309 A * 2/1988
JP 01158911 A * 6/1989
JP 02011302 A * 1/1990
JP 02305602 A * 12/1990
JP 03000204 A * 1/1991
JP 03021401 A * 1/1991
JP 03021402 A * 1/1991
JP 03027902 A * 2/1991
JP 03104601 A * 5/1991
JP 04146101 A * 5/1992
JP 04185302 A * 7/1992
JP 04201504 A * 7/1992
JP 04208402 A * 7/1992
JP 05169406 A * 7/1993
JP 06071617 A * 3/1994
JP 06088095 A * 3/1994
JP 06091611 A * 4/1994
JP 06091614 A * 4/1994
JP 07052106 A * 2/1995
JP 08080513 A * 3/1996
JP 08300313 A * 11/1996
JP 08332646 A * 12/1996
JP 10006309 A * 1/1998
JP 10071609 A * 3/1998
JP 10249812 A * 9/1998
JP 10338767 A * 12/1998
JP 11061142 A * 3/1999
JP 11105007 A * 4/1999
JP 11217401 A * 8/1999
JP 11235563 A * 8/1999
JP 11323757 A * 11/1999
JP 2000070604 A * 3/2000
JP 2000128663 A * 5/2000
JP 2000143223 A * 5/2000
JP 2000263621 A * 9/2000
JP 2000326310 A * 11/2000
JP 2001138307 A * 5/2001
JP 2001327943 A * 11/2001
JP 2002137204 A * 5/2002
JP 2002233400 A * 8/2002
JP 2002234002 A * 8/2002
JP 2002263465 A * 9/2002
JP 2002282405 A * 10/2002
JP 2003049355 A * 2/2003
JP 2003306393 A * 10/2003
JP 2005053510 A * 3/2005
JP 2006036977 A * 2/2006
JP 2006082353 A * 3/2006
JP 2006321068 A * 11/2006
JP 2007192464 A * 8/2007
JP 2007313476 A * 12/2007
JP 2008105957 A * 5/2008
JP 2008173925 A * 7/2008
JP 2008194948 A * 8/2008
JP 2008273915 A * 11/2008
JP 2009190260 A * 8/2009
JP 2010205712 A * 9/2010
WO WO 8701432 A1 * 3/1987
WO WO 9635560 A1 * 11/1996
WO WO 9639294 A1 * 12/1996
WO WO 9923429 A1 * 5/1999

* cited by examiner

METHOD FOR DRYING LUMBER, METHOD OF IMPREGNATING LUMBER WITH CHEMICALS, AND DRYING APPARATUS

BACKGROUND OF THE INVENTION

1. Field of the Invention

The invention relates to a method for drying lumber by using supercritical fluid, a method for impregnating lumber with chemicals, and a drying apparatus.

2. Description of the Related Art

Pieces of lumber newly cut from trees (green lumber) contain a substantial amount of moisture. The amount of moisture depends on such factors as the type of trees and growth conditions, and often reaches or exceeds one half of green lumber by weight. Because of this, if green lumber is used as housing materials or the like without being dried, the lumber will shrink causing cracking or deformation due to gradual evaporation of moisture after the buildings are completed. In the worst case, this may even result in life-threatening dangerous buildings such as so-called defective home. To avoid such problems, it is necessary to dry lumber by an appropriate amount of moisture before use. Various lumber drying techniques have been used for this purpose.

Air drying, a classic technique for drying lumber, involves stacking pieces of lumber in a staggered fashion to allow water evaporation. This does not require active use of energy but the drying takes a long time, in the order of several months. For this reason, kiln driers are now typically used to complete drying in seven to nine days or so. For a further reduction in the drying period, superheated steam can be used with pressure control, so that humidity is lowered gradually to finish drying in three to four days. Reduced-pressure drying, involving lowering the boiling point by decompression for faster drying, and high-frequency drying for accelerated drying within the lumber as well as at the surface, are sometimes used in combination. A plurality of drying techniques may also be combined as appropriate for a reduced period of treatment and for a uniform finish, though with a considerable increase in cost due to factors such as the amount of energy used.

SUMMARY OF THE INVENTION

An object of the present invention is to provide a method and an apparatus for drying lumber in a short period of time with less energy.

To solve the foregoing problems, the inventors have made intensive studies and found that the foregoing problems can be solved utilizing the properties of supercritical fluid, and have thus achieved the present invention.

More specifically, the gist of the present invention pertains to the following.

(1) A method for drying lumber comprising the steps of: loading lumber and fluid into a batch container having a pressure release valve; maintaining a temperature and a pressure at or above a critical point of the fluid for a given period of time; and then opening the valve of the batch container to reduce the internal pressure to atmospheric pressure.

(2) The method for drying lumber according to (1), wherein the fluid is liquid or gaseous carbon dioxide or nitrogen.

(3) A method for impregnating lumber with chemicals, comprising the steps of: enclosing lumber in a batch container having a pressure release valve; filling the batch container with fluid under pressure; maintaining a temperature and a pressure at or above a critical point of the fluid; opening the pressure release valve of the batch container to reduce the internal pressure to atmospheric pressure; and impregnating the resulting treated lumber with liquid chemicals.

(4) The method for impregnating lumber with chemicals according to (3), wherein the fluid is liquid or gaseous carbon dioxide or nitrogen.

(5) An apparatus for drying lumber, comprising: a batch container for accommodating lumber; a pressure release valve provided on the batch container; a filling container containing fluid; a pressure pump for injecting the fluid from the filling container into the batch container under pressure; and a heater for heating the batch container.

The present invention has the following effects.

(1) Since lumber can be dried by treatment even at a low temperature in the order of 40° C., it is possible to significantly reduce energy consumption as compared to conventional heat-drying techniques.

(2) Even very quick treatment can reduce the moisture content by several tens of percent, only requiring a total of one hour or so for a single round of treatment. This method of the present invention can be employed to significantly shorten a drying process that would take at least several days by conventional techniques.

(3) Pieces of lumber dried by the method of the present invention greatly improve in water permeability. This enables wood preservatives and termiticides to be impregnated sufficiently and uniformly into the core of lumber following the drying treatment. It is accordingly possible to manufacture lumber with high durability.

DETAILED DESCRIPTION OF THE PREFERRED EMBODIMENTS

Figure 1:
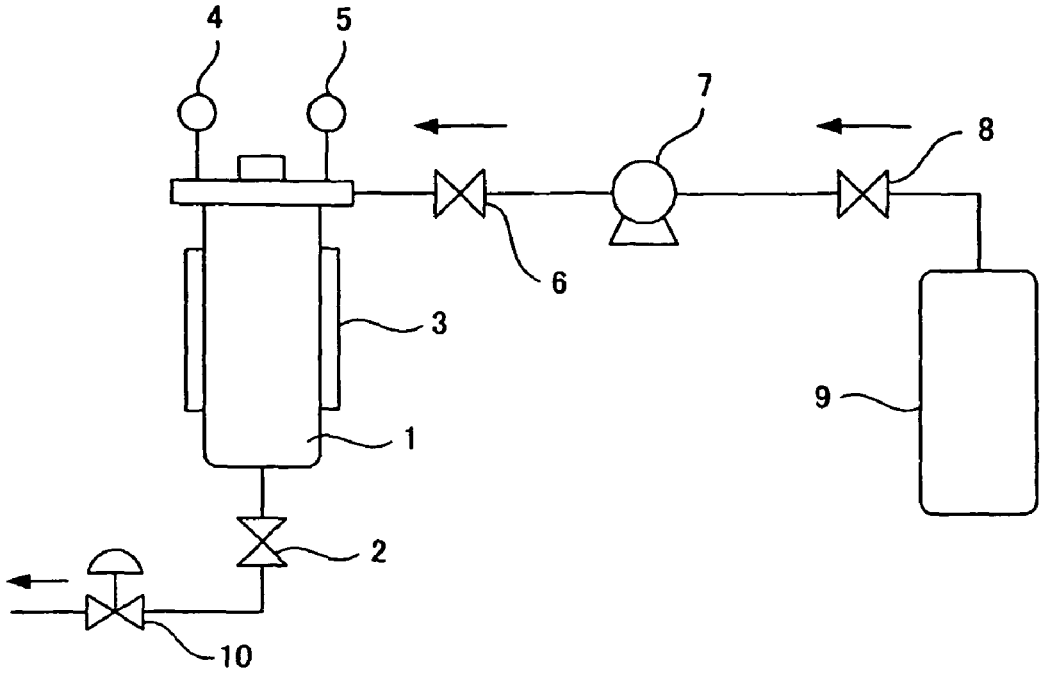
FIG. 1 is a block diagram showing an embodiment of a drying apparatus according to the present invention.

Lumber to be treated by the present invention is not limited to any particular type of tree. Neither the moisture content of the lumber (the weight percent of moisture with respect to the dry weight of lumber) nor the sectional configuration thereof is limited in particular.

The batch container for use in the present invention is not limited to any particular type as long as it can accommodate the lumber to be dried and retain super critical fluid. Containers having a cylindrical shape are preferable, however, since they withstand the state of supercritical high pressure more easily. For material, stainless steels having high corrosion resistance, such as SUS 316, are desirable.

Among examples of supercritical fluid suitable for use with the method of the present invention are supercritical carbon dioxide and supercritical nitrogen. Supercritical carbon dioxide is expected to be particularly effective. The reason is unknown, but supercritical carbon dioxide seems to have a high solubility in water. Accordingly, since the operation of intense decompression is performed with a large amount of supercritical carbon dioxide in solution in the water within lumber, carbon dioxide will be gasified to powerfully drive moisture out of the lumber.

A description will now be given of the method for drying lumber according to the present invention.

The batch container, having lumber enclosed therein, is filled with gaseous or liquid fluid using a compression pump with a pressure at or above the critical point of the fluid. To reach temperatures at or above the critical point, the container may be preheated before the fluid is introduced under pressure. Otherwise, the pressure-filling with the fluid may be completed before heating the batch container. The critical point of the fluid is 31° C./7.4 MPa for carbon dioxide, and −147° C./3.4 MPa for nitrogen.

The temperature and pressure conditions are not limited to particular values so long as the critical point is reached or exceeded.

The temperature range is from 40° C. to 120° C., preferably 40° C. to 90° C., and yet more preferably 40° C. to 80° C. The pressure range is from 10 to 30 MPa, preferably 10 to 25 MPa, and yet more preferably 10 to 20 MPa.

The temperature and pressure are maintained at or above the critical point of the fluid for a given period of time. This causes the supercritical fluid to permeate into the center of the lumber such that the supercritical fluid is dissolved into a large amount of the water contained in the lumber. The maintaining period is from 5 to 60 minutes, preferably 10 to 40 minutes, and yet more preferably 20 to 40 minutes.

After the given period of maintaining the temperature and pressure, the valve of the batch container is opened to reduce the internal pressure to atmospheric pressure. When the valve is opened, the supercritical fluid permeated into the lumber and the associated moisture are released from the lumber, thereby drying the lumber. The decompression rate depends on the size of the batch container. A container having a capacity of, for example, 2 liters is desirably decompressed to atmospheric pressure in about 30 to 90 seconds.

For example, in an experiment which has been made, a piece of green heartwood of Japanese cedar lumber having a size of 700 mm (L)×30 mm (R)×30 mm (T) was put into a batch container of approximately 2 liters in capacity, and was maintained with supercritical carbon dioxide at 70° C. to 80° C./10 MPa for 40 minutes before being decompressed to atmospheric pressure in approximately 60 seconds. The green lumber having an initial moisture content of 164.3% dropped to 95.3% immediately after the valve was opened. Even after the initial opening, the lumber continued ejecting moisture and carbon dioxide from the surface for about one to two hours at room temperatures under atmospheric pressure. The moisture content dropped to 81.0% in two hours, and 57.2% in 24 hours after the treatment.

As above, it became evident that the drying process which formerly took several days by conventional techniques such as kiln drying and superheated steam treatment can be shortened significantly with the use of supercritical fluid. Moreover, while the conventional techniques have required temperatures as high as 120° C. to 140° C. for drying, the supercritical fluid yields a sufficient drop in moisture content even with treatment at a low temperature of 40° C. to 45° C. This allows a significant reduction in energy use.

Possible embodiments of the method of the present invention include one in which the present invention is practiced once only, one in which the present invention is practiced several times in succession to lower the moisture content in a short period of time, and one in which the present invention is practiced in combination with or as pre-processing or post-processing for conventional drying techniques.

Pieces of lumber dried by the present invention greatly improve in permeability. Liquid chemicals such as wood preservatives and termiticides can thus be sufficiently impregnated into the core of the lumber as a chemical treatment following the drying treatment. The reason for the improved permeability is unknown, but it seems that the rapid decompression to atmospheric pressure removes not only water but also depositions such as wood extractives adhering to and deposited on water passages in lumber, thereby improving water permeability. Some pits in wood cell walls may also be damaged by the sharp drop in pressure, possibly contributing to the improved permeability.

Examples of wood preservatives with which to impregnate the lumber include cupric oxide, cupric hydroxide, cyproconazole, tebuconazole, and zinc naphthenate. Examples of termiticides include phoxim, imidacloprid, propetamphos, and permethrin. Other chemicals such as phenol resins, PEG, acid dyes, and direct dyes may be similarly impregnated into the lumber without any particular limitation.

For impregnating the lumber with liquid chemicals, ordinary techniques such as immersion and vacuum treatments may be used as well as vacuum/pressure treatment. The vacuum/pressure treatment includes several combination patterns, including the Bethell process (full cell process), Ruping process (empty cell process), Lowry process (semi-empty cell process), and a multi-vacuum/pressure process (oscillation process).

FIG. 1 shows an embodiment of the lumber drying apparatus according to the present invention.

The reference numeral 1 indicates a batch container for lumber to be enclosed in. This batch container 1 has a pressure release valve 2 for reducing the internal pressure to atmospheric pressure, and a back pressure valve 10 for adjusting the decompression rate. The batch container 1 also has a pressure gauge 4 and a thermometer 5 for measuring the pressure and temperature inside.

A filling container 9 contains liquid or gaseous fluid, and from this container the fluid is introduced into the batch container 1 under pressure via a valve 8, a compression pump 7, and a valve 6. The fluid introduced into the container under pressure is heated by a heater 3, and the resulting supercritical fluid permeates into the lumber. The super critical state is maintained for a given period of time before the valve 2 is opened to reduce the internal pressure of the container to atmospheric pressure.

[Embodiment 1]

Using the apparatus shown in FIG. 1, an experiment was conducted on drying lumber with supercritical carbon dioxide. A single piece of sample lumber was put into and enclosed in the batch container having a capacity of 2 liters. The sample lumber was a piece of green heartwood of Japanese cedar (100 mm (L)×30 mm (R)×30 mm (T)). Next, carbon dioxide was injected into the batch container by using the compression pump, and was heated and compressed to the temperatures and pressures shown in Table 1. After this state had been maintained for 40 minutes, the valve at the container bottom was opened to release carbon dioxide and reduce pressure to atmospheric pressure in 30 to 90 seconds.

After the treatment, the test piece was taken out and measured for weight immediately. The moisture content (MC) was determined by the following equation:

$$MC = \frac{W - W_d}{W_d} \times 100\,(\%) \qquad \text{[Eq. 1]}$$

(where Wd is the total dry weight of a piece, and W is the weight of the piece).

The test piece was left in atmosphere at room temperature and again measured for weight 30 minutes, 1 hour, 2 hours, and 24 hours after the treatment, determining the moisture contents. Table 1 shows the results.

TABLE 1

Lumber drying experiment with supercritical/gaseous/liquid carbon dioxide

| Treatment condition | | | | Moisture content (%) | | | | | |
|---|---|---|---|---|---|---|---|---|---|
| Temperature (° C.) | Pressure (Mpa) | Decompression time (sec) | State of $CO_2$ | Before treatment | Immediately after treatment | After 30 minutes | After 1 hour | After 2 hours | After 24 hours |
| 40-45 | 10 | 80 | Supercritical | 151.6 | 114.9 | 93.9 | 91.3 | 88.7 | 54.1 |
| 70-80 | 10 | 60 | Supercritical | 164.3 | 95.3 | 85.7 | 83.4 | 81.0 | 57.2 |
| 70-80 | 17 | 80 | Supercritical | 209.0 | 131.1 | 119.3 | 117.0 | 112.3 | 84.0 |
| 70-80 | 25 | 90 | Supercritical | 139.2 | 80.0 | 71.5 | 69.4 | 67.3 | 46.1 |
| 70-80 | 1.5 | 30 | Gaseous | 171.2 | 163.5 | 153.3 | 153.3 | 150.7 | 120.0 |
| 24-25 | 10 | 80 | Liquid | 148.2 | 134.0 | 110.4 | 100.9 | 96.2 | 64.5 |

When carbon dioxide was in a supercritical fluid state during treatment, moisture contents of 139.2% to 209.0% before treatment fell to 80.0% to 131.1% immediately after treatment (within 5 minutes of the treatment). The average rate of decrease of the moisture content was approximately 37%. Even after the treatment, the pieces of lumber continued releasing moisture and carbon dioxide from their surfaces for about one to two hours while left at room temperatures under atmospheric pressure. The moisture contents dropped to between 67.3% and 112.3% in two hours, and between 46.1% and 84.0% in 24 hours after the treatment.

When carbon dioxide was in a gaseous state during treatment, on the other hand, the moisture content fell only slightly. When carbon dioxide was in a liquid state during treatment, the moisture content decreased to some extent due to heavy discharge of moisture from immediately after the treatment up to one hour after. As compared to the treatments in the supercritical state, however, the decrease in moisture was not so sharp.

From the foregoing, it was found that the use of supercritical carbon dioxide makes it possible to dry lumber in an extremely short time.

The supercritical carbon dioxide treatment was then repeated on an identical test piece three times in succession to check for changes in moisture content. All three treatments were under the same treatment conditions of 70° C. to 80° C. temperature, 10 MPa pressure, and 60 seconds decompression time. Table 2 shows the results.

TABLE 2

Changes in moisture content by consecutive treatments with supercritical carbon dioxide

| Moisture content (%) | | | | | | | |
|---|---|---|---|---|---|---|---|
| Before treatment | Immediately after first treatment | Immediately after second treatment | Immediately after third treatment | After 30 minutes | After 1 hour | After 2 hours | After 24 hours |
| 128.1 | 88.8 | 64.5 | 53.3 | 49.6 | 47.7 | 47.7 | 40.2 |

Performing the supercritical carbon dioxide treatment three times in succession lowered the moisture content from 128.1% to 53.3%, or approximately by half. Each single treatment required approximately one hour. That is, the short total treatment time of approximately three hours could reduce the moisture content significantly.

This confirmed that treatment with supercritical carbon dioxide can be repeated to dry lumber even within a short time period.

[Embodiment 2]

Next, a drying experiment was performed with supercritical nitrogen. The apparatus used was the same as that of FIG. 1 except that the batch container had a capacity of approximately 900 ml and the container contained nitrogen gas.

A test piece of heartwood of Japanese cedar (100 mm (L)×30 mm (R)×30 mm (T)) was put into and enclosed in the batch container. Nitrogen was then introduced into the container, and heated and compressed to the temperatures and pressures shown in Table 3. After this state was maintained for 20 minutes, the valve at the container bottom was opened to release nitrogen and reduce pressure to atmospheric pressure within 15 to 20 seconds.

After the processing, the test piece was taken out and measured for weight immediately, and the moisture content was determined. The test piece was left inside and again measured for weight 30 minutes, 1 hour, 2 hours, 24 hours, and 48 hours after the treatment, determining the moisture contents. Table 3 shows the results.

TABLE 3

| Lumber dry experiment with supercritical nitrogen | | | | | | | | | |
|---|---|---|---|---|---|---|---|---|---|
| Treatment condition | | | Moisture content (%) | | | | | | |
| Temperature (° C.) | Pressure (Mpa) | Decompression time (sec) | Before treatment | Immediately after treatment | After 30 minutes | After 1 hour | After 2 hours | After 24 hours | After 48 hours |
| 28 | 12.2 | 15 | 231.5 | 217.7 | 207.4 | 203.1 | | 139.0 | |
| 50 | 13 | 15 | 217.3 | 206.4 | 201.1 | 198.5 | 194.7 | 142.2 | |
| 90 | 16 | 20 | 207.8 | 158.9 | 149.8 | 147.2 | 144.0 | | 63.9 |
| 110 | 16 | 20 | 257.5 | 187.6 | 173.7 | 170.3 | 166.4 | 105.2 | |

Nitrogen has a critical point at −147° C. and 3.4 MPa. In this experiment, nitrogen was in a supercritical state throughout. At temperatures of 28° C. and 50° C., the treatment yielded only a slight decrease in moisture content. In contrast, at temperatures 90° C. and 110° C., the moisture content immediately after treatment fell to approximately three-fourths of that before the treatment, showing a significant drop in moisture content as with the treatment with supercritical carbon dioxide.

From the foregoing results, it became evident that supercritical nitrogen can be used to provide an effective drying treatment if at or above 90° C.

[Embodiment 3]

In order to evaluate the water permeability of lumber dried with supercritical carbon dioxide, the following experiment was conducted.

Figure 2:
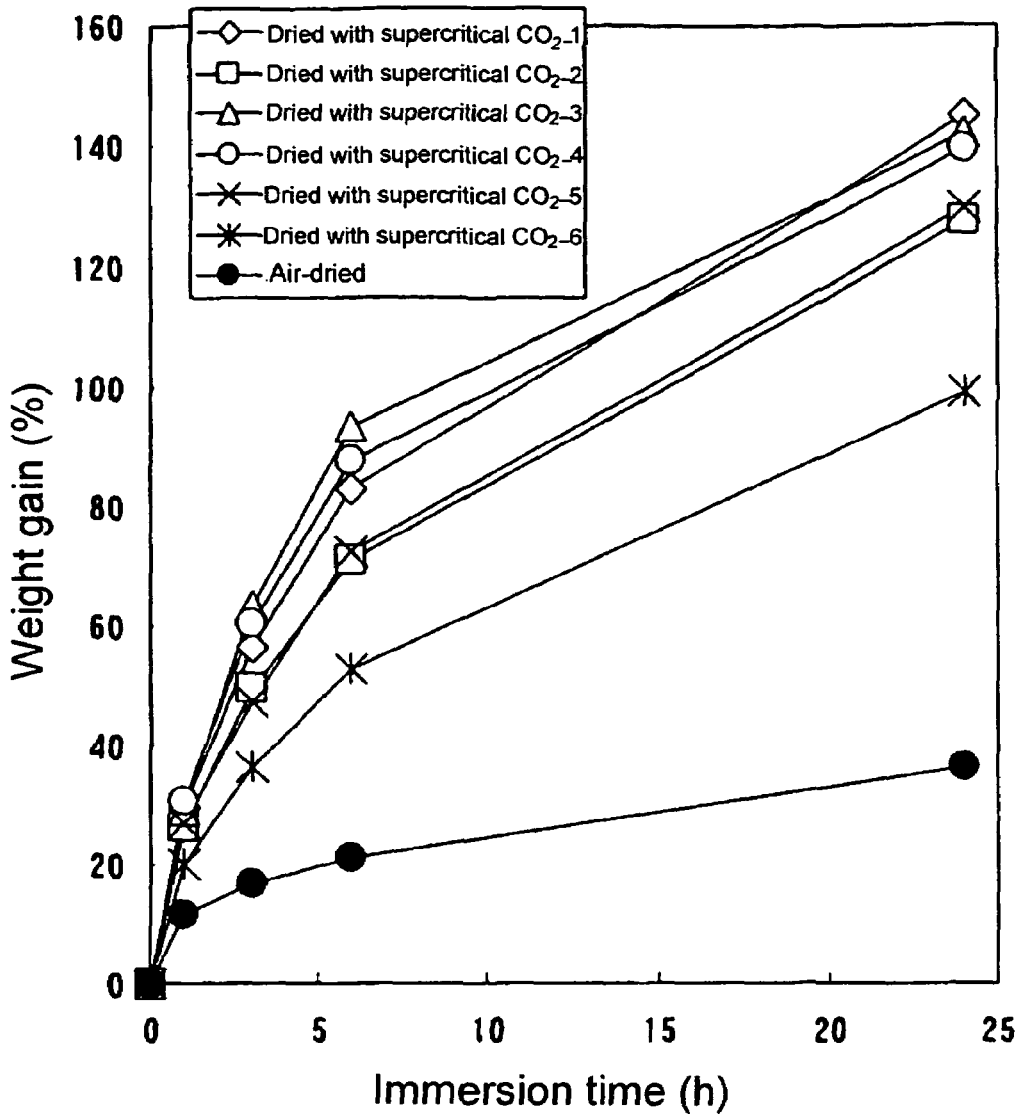
FIG. 2 is a graph showing results of a water permeability evaluation experiment in embodiment 3.

A test piece of green heartwood of Japanese cedar (100 mm (L)×15 mm (R)×15 mm (T)) was treated with supercritical carbon dioxide using the same method as in embodiment 1. The treatment conditions were 120° C. temperature and 17 MPa pressure, with a maintaining time of 20 minutes and a decompression time of 15 seconds. After the treatment, the test piece was left in atmosphere at room temperature to dry to an air-dry state. To evaluate the permeability of the dried piece, the longitudinal-tangential (LT) and the longitudinal-radial (LR) surfaces of the test piece were sealed with one-component RTV rubber, and then the radial-tangential (RT) surface of the test piece was soaked in pure water to a depth of about 5 mm. The test piece was fixed on a wire basket so that the longitudinal direction of wood was vertical in the water. The test piece was then measured for the rate of weight increase after 1, 3, 6, and 24 hours. For the sake of comparison, a sample piece of green lumber was air-dried and subjected to the same experiment. FIG. 2 shows the results.

Six test pieces dried with the supercritical carbon dioxide treatment showed rates of weight increase 2.5 to 4 times higher than that of the air-dried lumber. This made it clear that the drying treatment according to the method of the present invention significantly improves the water permeability of lumber.

Since the present invention can reduce the power consumption required in drying lumber and can dry lumber in a short time, it is suited for technologies for drying construction lumber etc. In addition, since the method of present invention dries lumber with an improvement in permeability and chemicals thus permeate into the lumber efficiently, it is suited to improving the durability of lumber.

What is claimed is:

1. A method for drying lumber comprising the steps of:

enclosing green lumber in a batch container having a pressure release valve;

filling supercritical fluid into the batch container;

maintaining the temperature in a range from 40° C. to 120° C. and pressure in a range from 10 to 30 MPa for a given period of time; and then opening the pressure release valve of the batch container to reduce the internal pressure to atmospheric pressure.

2. The method for drying lumber according to claim 1, wherein the supercritical fluid is supercritical carbon dioxide or supercritical nitrogen.

3. The method for drying lumber according to claim 1, wherein the maintaining period is from 5 to 60 minutes.

4. The method for drying lumber according to claim 1, wherein the decompression rate is from 30 to 90 seconds per 2 liters of supercritical fluid.

5. The method for drying lumber according to claim 1, wherein the supercritical fluid treatment is performed from one to three times on the identical lumber.

6. A method for improving the permeability of lumber, comprising the steps of:

enclosing green lumber in a batch container having a pressure release valve;

filling supercritical fluid into the batch container;

maintaining the temperature in a range from 40° C. to 120° C. and pressure in a range from 10 to 30 MPa for a given period of time; and then opening the pressure release valve of the batch container to reduce the internal pressure to atmospheric pressure.

7. The method for improving the permeability of lumber according to claim 6, wherein the supercritical fluid is supercritical carbon dioxide or supercritical nitrogen.

8. The method for improving the permeability of lumber according to claim 6, wherein the maintaining period is from 5 to 60 minutes.

9. The method for improving the permeability of lumber according to claim 6, wherein the decompression rate is from 30 to 90 seconds per 2 liters of supercritical fluid.

10. The method for improving the permeability of lumber according to claim 6, wherein the supercritical fluid treatment is performed from one to three times on the identical lumber.

* * * * *